United States Patent [19]

Nakazawa et al.

[11] Patent Number: 4,726,783

[45] Date of Patent: Feb. 23, 1988

[54] LOCKING MECHANISM FOR CONNECTORS

[75] Inventors: Akira Nakazawa; Shigeru Kikuta; Kihachiro Koike; Kensaku Matsuoka; Yoshimitsu Nishino, all of Tokyo, Japan

[73] Assignee: Hirose Electric Company, Ltd., Tokyo, Japan

[21] Appl. No.: 848,317

[22] Filed: Apr. 4, 1986

[30] Foreign Application Priority Data

Apr. 4, 1985 [JP] Japan ..... 60-50185[U]

[51] Int. Cl.[4] ..... H01R 13/631

[52] U.S. Cl. ..... 439/350

[58] Field of Search ..... 339/91 R, 75 R, 75 M; 439/345, 347, 350, 357, 358

[56] References Cited

U.S. PATENT DOCUMENTS

| | | | |
|---|---|---|---|
| 1,899,360 | 2/1933 | Roudebush et al. | 339/91 R |
| 2,760,174 | 8/1956 | Burtt et al. | 339/91 R |
| 3,566,336 | 2/1971 | Johnson | 339/91 R |
| 4,012,097 | 3/1977 | Long et al. | 339/45 M |
| 4,017,138 | 4/1977 | Evans | 339/75 MP |
| 4,460,230 | 7/1984 | McKee et al. | 339/91 R |
| 4,462,654 | 7/1984 | Aiello | 339/91 R |
| 4,556,270 | 12/1985 | Schutzle et al. | 339/91 R |
| 4,678,256 | 7/1987 | Nishino et al. | 439/347 |

FOREIGN PATENT DOCUMENTS

| | | | |
|---|---|---|---|
| 2352419 | 12/1977 | France | 339/91 R |

OTHER PUBLICATIONS

"Spring Retainer", Evans, IBM Technical Disclosure Bulletin, vol. 16, No. 12, 5/1974.

*Primary Examiner*—John McQuade

*Attorney, Agent, or Firm*—Harry M. Weiss & Associates

[57] ABSTRACT

A locking mechanism for connectors comprises a locking member having an engaging portion, a pressing portion and a fulcrum between the engaging portion and the pressing portion. The fulcrum of the locking member has a bent portion mounted around a fulcrum projection formed on a connector cover. The connector cover is formed with a wall extending inside of the projection. The pressing portion is formed with an elastic tongue piece for displacing outwardly the pressing portion and inwardly the engaging portion about the projection with the free end of the tongue piece in contact with the wall when the fulcrum is mounted on the projection, whereby the engaging portion is externally swung open about the projection when the pressing portion is pressed inwardly against the displacing force of the tongue piece. The pressing portion is formed with a stopper for stopping the pressing portion from further inwardly moving by making contact with the extension of the wall.

2 Claims, 9 Drawing Figures

LOCKING MECHANISM FOR CONNECTORS

BACKGROUND OF THE INVENTION

1. Field of the Invention

This invention relates to a locking mechanism for connectors.

2. Description of the Prior Art

Various types have been as a mechanism for locking or latching the coupling state of connectors, but a shaftless mechanism having no shaft which can be readily assembled merely by fitting a locking member within a connector case has been proposed. An example is disclosed in Japanese Utility Model Publication No. 53-47580 official gazette. Its schematic construction is as shown in FIGS. 8 and 9 of the accompanying drawings. FIG. 8 is a front sectional view showing the state that a locking member is mounted on a connector cover, and FIG. 9 shows a sectional view taken along the line 9—9 of FIG. 8.

As shown in FIGS. 8 and 9, the conventional shaftless locking mechanism has a locking member 1, a hook-shaped engaging portion 2 formed at one end of the member 1, and a pressing portion 3 formed at the other end. Elastic pieces 4 and 4' made of a flexible material are provided at both sides of the member 1. The pieces 4 and 4' are, as shown, formed of the same elastic member as the member 1 but being weaker than the portion of the member 1, i.e., formed to be narrower than the width of the member 1, and a reinforcing strip 5 is formed at the member 1 side to be harder than the portions of the pieces 4 and 4'. The connector cover is formed of split cases 6 and 6', and grooves 7 and 7' for engaging the ends of the pieces 4 and 4' are respectively formed in the cases 6 and 6'. When the ends of the pieces 4 and 4' of the member 1 are respectively inserted into the grooves 7 and 7' and the member 1 is thus associated, the engaging portion 2 is opposed to hook pieces 8 and 8' formed at the other side of the connector, and the pressing portion 3 are mounted oppositely to windows 9 of the cases 6, 6'. In FIG. 8, when the pressing portion 3 is pressed into the window 9, since the ends of the pieces 4 and 4' are inserted into the grooves 7 and 7', the engaging portion is deflected between the inserting portion and the connecting portions 10 and 10' and actuated in the direction opposite to the pressing portion 3, separated from the pieces 8 and 8' so that the coupled connectors can be disengaged from one another.

The abovementioned locking mechanism can be readily assembled and enable the lock and unlock of connectors, but since the mechanism does not have a stationary fulcrum point, it is difficult to restrict that the relative movement of the engaging portion 2 with respect to the hook pieces 8 and 8' of the opposed side connector is always maintained suitable. Particularly, when the engaging portion 2 is disengaged from the pieces 8 and 8', it might not be preferably disengaged. Further, the passing portion 3 of the locking member 1 in the conventional locking mechanism displaces, if an external force is applied thereto, in response to the external force, and the displacement excessively increases, if considerably large external force is applied, and the pressing portion 3 might be deformed.

An object of this invention is to provide a locking mechanism which can eliminate the abovementioned disadvantages of the conventional locking mechanism and can be readily assembled and enable the reliable lock and unlock of connectors and can be prevented from being deformed by a large external force.

SUMMARY OF THE INVENTION

According to this invention, there is provided a locking mechanism for connectors comprising a locking member having an engaging portion, a pressing portion and a fulcrum between the engaging portion and the pressing portion, the fulcrum of the locking member has a bent portion which receives and accommodates a fulcrum projection formed on a connector cover. The connector cover is formed with a wall extending inside the fulcrum projection, the pressing portion being formed with an elastic tongue piece for outwardly displacing the pressing portion and inwardly displacing the engaging portion about the projection with the free end of the tongue piece in contact with the inner wall when the fulcrum is mounted on the projection. Thus, the engaging portion is externally swung open about the projection when the pressing portion is pressed inwardly against the tongue piece. The pressing portion is formed with a stopper for stopping the pressing portion from further inwardly moving by making contact with the extension of the inner wall.

This invention will now be described in further detail with regard to preferred embodiments as illustrated in the accompanying drawings.

DESCRIPTION OF THE PREFERRED EMBODIMENTS

Figure 1:
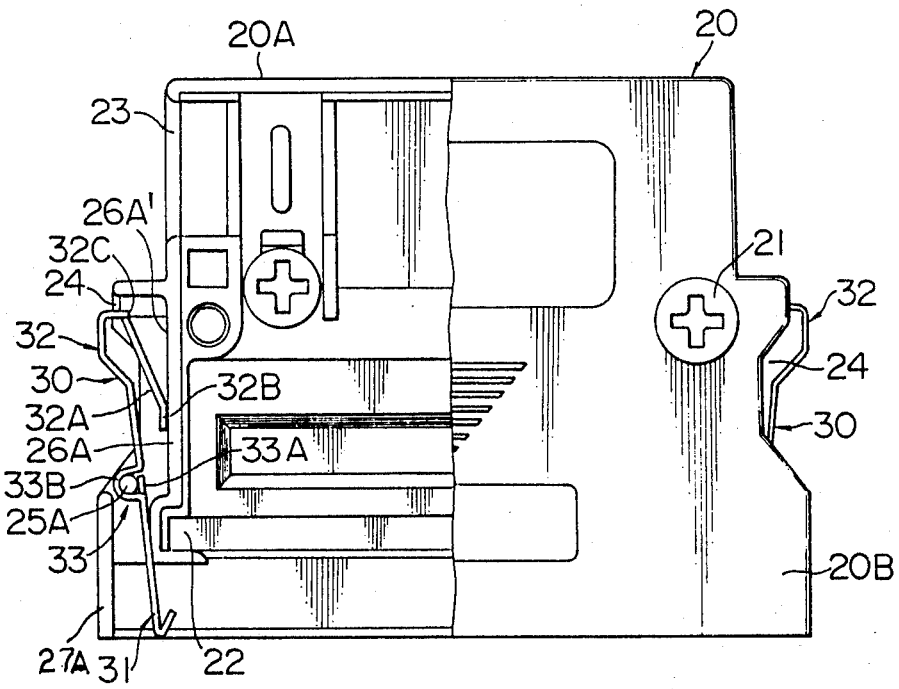
FIG. 1 is a half sectional front view showing a connector cover associated with a locking mechanism as an embodiment of this invention.
Figure 2:
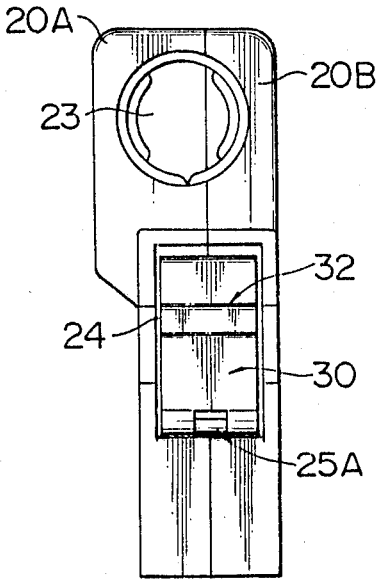
FIG. 2 is a side elevational view of the locking mechanism according to the present invention.

FIG. 1 is a half sectional front view showing a connector cover associated with a locking mechanism as an embodiment of this invention, and FIG. 2 is a side view of the connector cover of FIG. 1. The connector cover 20 is, as shown in FIG. 2, split into a cover section 20A and a cover section 20B. The cover sections 20A and 20B are assembled and clamped by a clamping screw 21. A groove 22 for inserting a flange of the connector is formed near the front end of the cover 20, and a cable pulling opening 23 for pulling a cable coupled with the connector is formed near the rear end of the cover 20. Further, a window 24 of an object to be described later is formed at the intermediate of the side of the cover 20.

Figure 3:
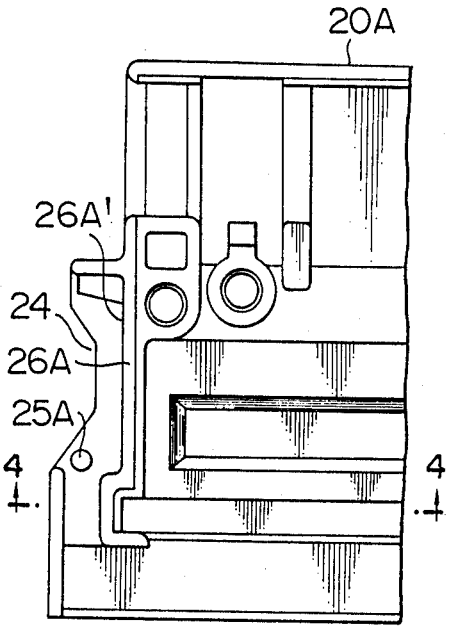
FIG. 3 is a partial top elevational view of a cover section of the locking mechanism according to the present invention.
Figure 4:
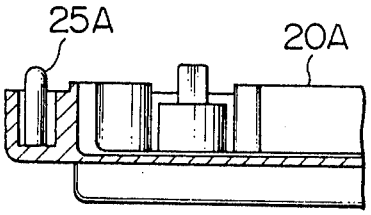
FIG. 4 is a partial cross-sectional view taken along line 4—4 of FIG. 3.

FIG. 3 is a view as seen from the inside of the cover section 20A, and FIG. 4 is a sectional view taken along the line 4—4 of FIG. 3. As shown in FIGS. 3 and 4, a fulcrum projection 25A which performs a function to be described later is erected near the window 24 of an outer wall 27A of the cover section 20A, and an inner wall 26A which is erected to perform a function to be described later is formed inside of the projection 25A.

Figure 5:
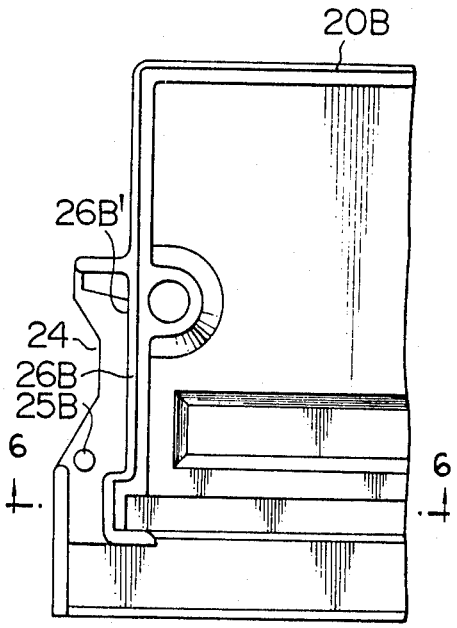
FIG. 5 is a partial top elevational view of a second cover section of the locking mechanism according to the present invention.
Figure 6:
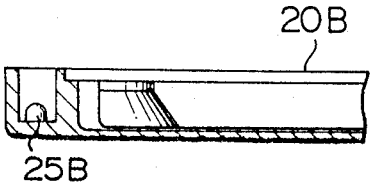
FIG. 6 is a partial cross-sectional view taken along line 6—6 of FIG. 5.

FIG. 5 is a partial view as seen from the inside of the cover section 20B, and FIG. 6 is a sectional view taken along the line 6—6 of FIG. 5. As shown in FIGS. 5 and 6, a fulcrum projection 25B is formed at the position corresponding to the projection 25A of the cover section 20A near the window 24 of an outer wall 27B of the cover section 20B. Further, an inner wall 26B is formed at the position corresponding to the wall 26A of the cover section 20A.

Figure 7:
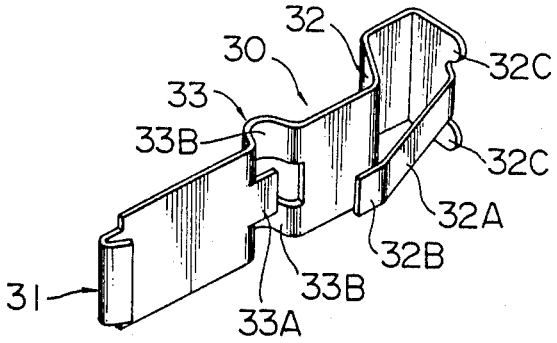
FIG. 7 is a perspective view of a locking member of the locking mechanism according to the present invention.
Figure 8:
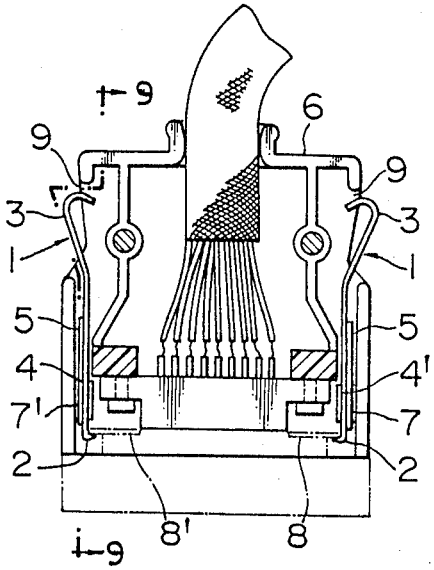
FIG. 8 PRIOR ART
FIG. 8 is a sectional front view showing an example of the conventional locking mechanism.
Figure 9:
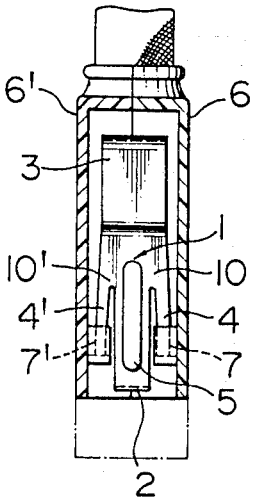
FIG. 9 PRIOR ART
FIG. 9 is a sectional view taken along the line 9—9 of FIG. 8.

As preferably shown in the left half of the sectional view of FIG. 1, a locking member 30 is mounted on the connector cover 20 by utilizing the abovementioned fulcrum projections 25A, 25B and inner walls 26A, 26B. FIG. 7 shows in a perspective view one of the locking members 30. As preferably shown in a perspective view of FIG. 7, the member 30 is integrally formed by punching and bending a metal material sheet having an elasticity, and has an engaging portion 31, a pressing portion 32 and a fulcrum 33 between the portions 31 and 32. The fulcrum 33 is formed of a bent portion 33B formed by bending the portions of both sides except a central punched tongue piece 33A, and mounted around the projection 25A of the cover section 20A as shown in FIG. 1. The pressing portion 32 is formed with an elastic tongue piece 32A for outwardly displacing the pressing portion 32 and inwardly displacing the engaging portion 31 about the projections 25A, 25B with the free end 32B of the tongue pieces 32A in contact with the wall 26A of the cover section 20A (or the wall 26B of the cover section 20B) when the fulcrum 33 is mounted on the projection 25A of the cover section 20A (or the projection 25B of the cover section 20B) as described above. When the pressing portion 32 is pressed inwardly against the displacing force of the tongue piece 32A in this state, the engaging portion 31 is externally swung open about the projections 25A, 25B, and disengaged from the hook piece of the opposed side connector. The engaging portion 31 is bent in a hook shape as shown. The pieces 32A is preferably formed by folding the material portion from the rear end of the pressing portion 32 toward the projections 25A, 25B and walls 26A, 26B. Further, stoppers 32C made of erected pieces extending at both sides of the tongue pieces 32A from the rear end of the pressing portion 32 toward the walls 26A, 26B, and make contact with the extensions 26A', 26B' of the walls 26A, 26B to prevent the pressing portion 32 from moving further inwardly. The pressing portion 32 of this structure is pressed by an operator's finger as observed from the window 24 of the side of the cover 20 when the locking member 30 is mounted at both sides of the cover 20 as shown in FIG. 1.

Since the locking mechanism of this invention is constructed as described above, the mechanism can be assembled merely by mounting the fulcrum of the locking member 30 on the fulcrum projection of the connector cover, and the locking member 30 can be accurately positioned on the connector cover. Since the engaging and disengaging operations of the locking member of this invention can be performed with the fulcrum projections and the fulcrum as center, the relative movement of the opposed connector of the engaging portion with respect to the hook piece can be always suitably performed, disengagement of the engaging portion from the hook portion can be performed without diffrculty. Further, since the stoppers are provided in the pressing portion of the locking mechanism of this invention, the displacement of the pressing portion due to large external force can be completely limited. Thus, the locking member may not be deformed to cause the member to be disabled for use.

What is claimed is:

1. A locking mechanism for holding a coupling between a connector and a mating connector having a hook piece, comprising:

an engaging portion disposed at one end of the locking mechanism, for engaging the hook piece of the mating connector to hold the coupling of the connector with the mating connector;

a pressing portion disposed at another end of the locking mechanism, said pressing portion further having a stopper portion and an elastic tongue piece extending therefrom, said elastic tongue piece further having a free end thereof directed toward said engaging portion;

a fulcrum, having a bent portion positioned substantially intermediate between said engaging portion and said pressing portion, wherein each of said engaging portion, said pressing portion and said fulcrum are integrally formed from a bent elastic metal sheet;

a connector cover having an outer wall, an inner wall positioned in close proximity to and inwardly from said outer wall and a fulcrum projection interdisposed between said outer wall and said inner wall, wherein said bent portion of said fulcrum is movably mounted around and accommodated by said fulcrum projection of said connector cover, said free end of said elastic tongue piece contacts said inner wall, thereby, outwardly displacing said pressing portion and inwardly displacing said engaging portion about said fulcrum projection, said pressing portion being exposed at a window in said outer wall, and substantially an entire portion of said engaging portion is covered by said outer wall, such that when said pressing portion is pressed inwardly through said window against said elastic tongue piece, said engaging portion is outwardly displaced about said fulcrum projection between said outer wall and said inner wall and, thereby, is disengaged from said hook piece of said mating connector and said stopper portion of said pressing portion contacts said inner wall thereby preventing further inward displacement of said pressing portion.

2. A locking mechanism as claimed in claim 1 wherein said connector cover comprises two cover halves and said fulcrum projection is formed at each of said cover halves.

* * * * *

UNITED STATES PATENT AND TRADEMARK OFFICE

CERTIFICATE OF CORRECTION

PATENT NO. : 4,726,783

DATED : Feb. 23, 1988

INVENTOR(S) : Akira Nakazawa; Shigeru Kikuta; Kihachiro Koike; Kensaku Matsuoka

It is certified that error appears in the above-identified patent and that said Letters Patent is hereby corrected as shown below:

On the title page:

Please add the following assignees to the above-identified U.S. Patent:

-- NEC Corporation -- and -- JAPAN Aviation Electronics Industry Limited --.

Signed and Sealed this

Fourteenth Day of March, 1989

*Attest:*

*Attesting Officer*

DONALD J. QUIGG

*Commissioner of Patents and Trademarks*